US005680674A

United States Patent [19]

Guthrie

[11] Patent Number: 5,680,674

[45] Date of Patent: Oct. 28, 1997

[54] DEVICE FOR CONTROLLING THE MOVEMENT OF A WING

[75] Inventor: Duncan Richard Guthrie, Melbourn, Great Britain

[73] Assignee: NT Door Controls Limited, Birmingham, United Kingdom

[21] Appl. No.: 628,693

[22] PCT Filed: Dec. 6, 1994

[86] PCT No.: PCT/GB94/02668

§ 371 Date: Apr. 17, 1996

§ 102(e) Date: Apr. 17, 1996

[87] PCT Pub. No.: WO95/16845

PCT Pub. Date: Jun. 22, 1995

[30] Foreign Application Priority Data

Dec. 17, 1993 [GB] United Kingdom ..... 9325906

[51] Int. Cl.[6] ..... E05F 3/10

[52] U.S. Cl. ..... 16/53; 16/55

[58] Field of Search ..... 16/50, 53, 58, 16/65, 80, 85, 54, 55, DIG. 17, DIG. 24

[56] References Cited

U.S. PATENT DOCUMENTS

| | | | |
|---|---|---|---|
| 1,957,308 | 5/1934 | Anderson | 16/61 |
| 2,653,043 | 9/1953 | Carlson | 16/80 |
| 3,398,434 | 8/1968 | Nieman | 16/80 |
| 3,950,819 | 4/1976 | Little | 16/85 |
| 4,788,742 | 12/1988 | Edgett et al. | 16/79 |

FOREIGN PATENT DOCUMENTS

| | | | |
|---|---|---|---|
| 0207251 | 1/1987 | European Pat. Off. . | |
| 2198528 | 3/1974 | France . | |
| 2258583 | 6/1974 | Germany . | |
| 3427609 | 2/1986 | Germany | 16/50 |
| 408698 | 2/1966 | Switzerland | 16/350 |
| 842988 | 8/1960 | United Kingdom . | |
| 1207841 | 10/1970 | United Kingdom . | |

*Primary Examiner*—Daniel W. Howell
*Assistant Examiner*—Mark Williams
*Attorney, Agent, or Firm*—Jacobson, Price, Holman & Stern, PLLC

[57] ABSTRACT

A door closer comprises a housing (21) in which a compression spring (23) urges a piston (22) in one direction, an operating spindle (18) in the housing defining an axis (19) about which an arm mechanism (52) connected to the housing is angularly movable to effect movement of the piston in the opposite direction. Connected between said axis (19) and the piston (22) is a linkage mechanism which provides that, in use, maximum torque is exerted on the arm mechanism at the near closed position of the door. The linkage mechanism can have a pivotal connection (27) between links (25, 26) thereof constrained to follow a continuous curve by means of a cam track (30, 31) or an additional link (48).

17 Claims, 10 Drawing Sheets

FIG. 9
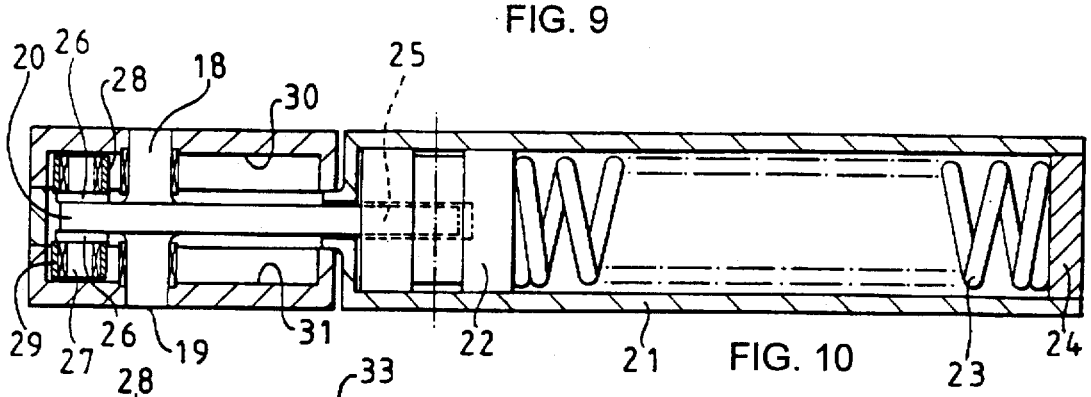
FIG. 10
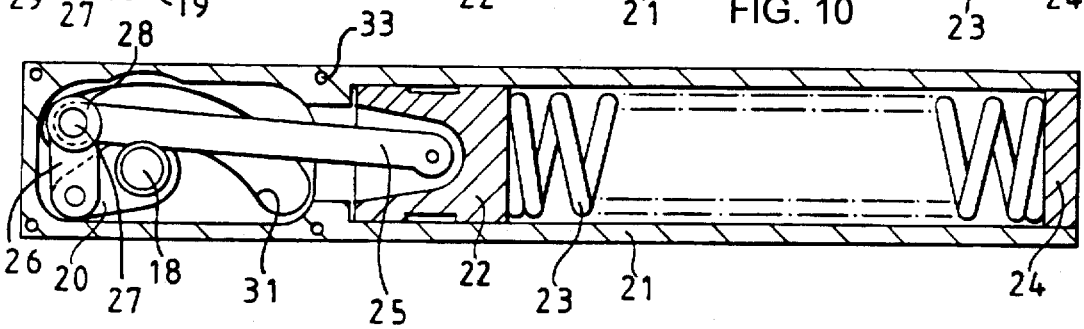
FIG. 11
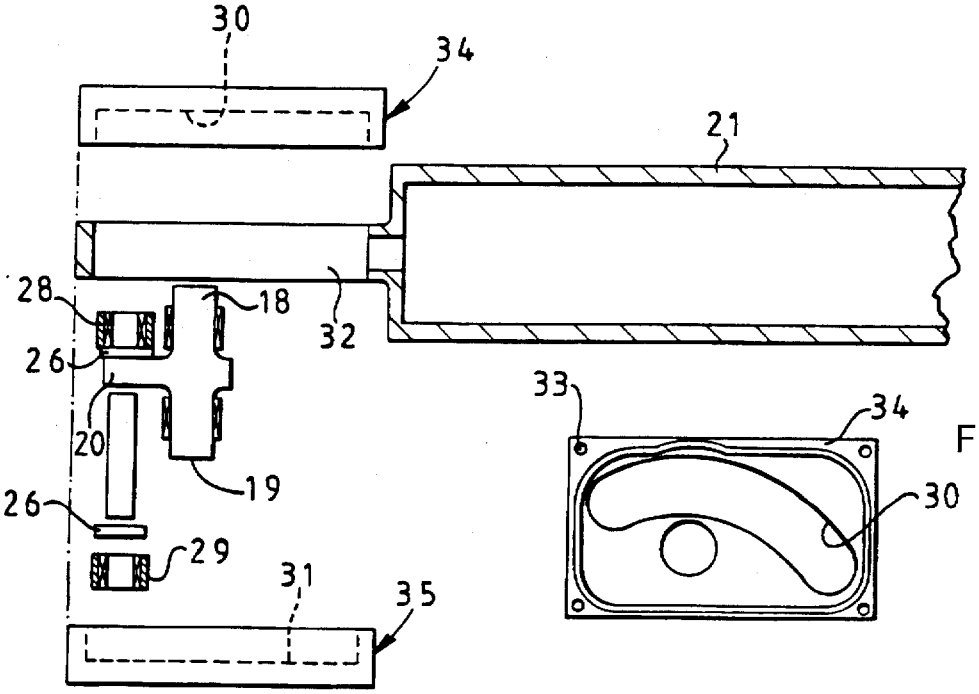
FIG. 12

FIG. 28
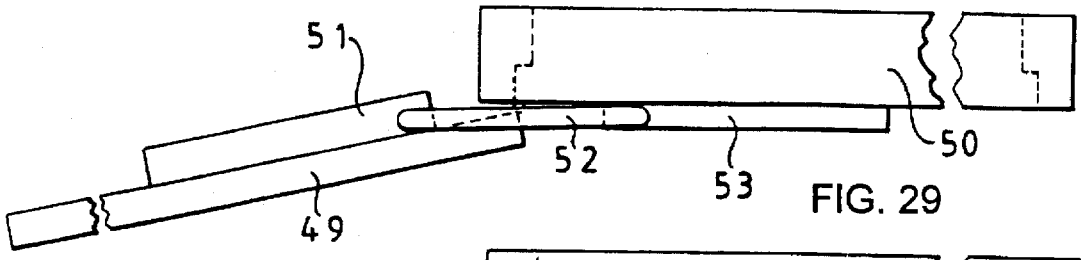
FIG. 29
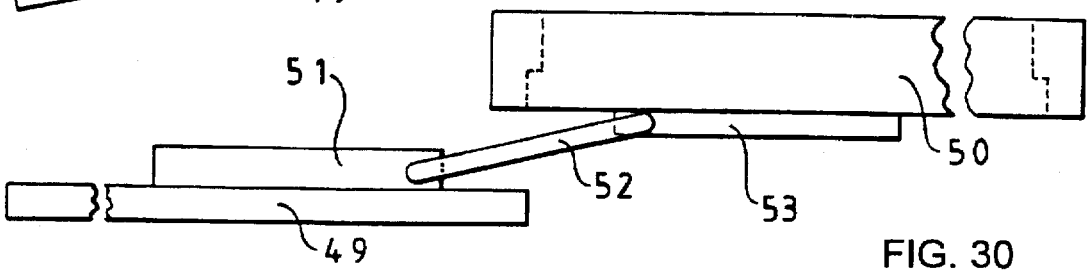
FIG. 30
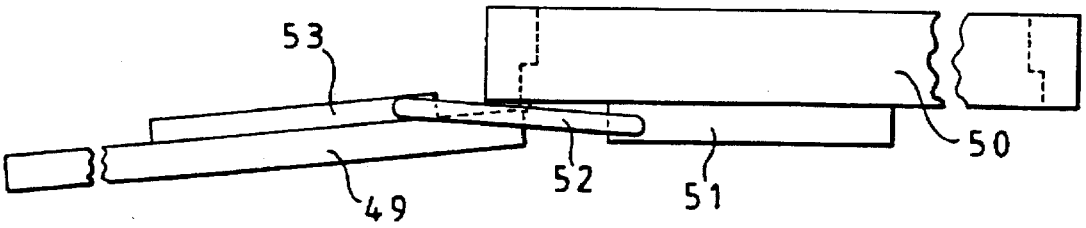
FIG. 31
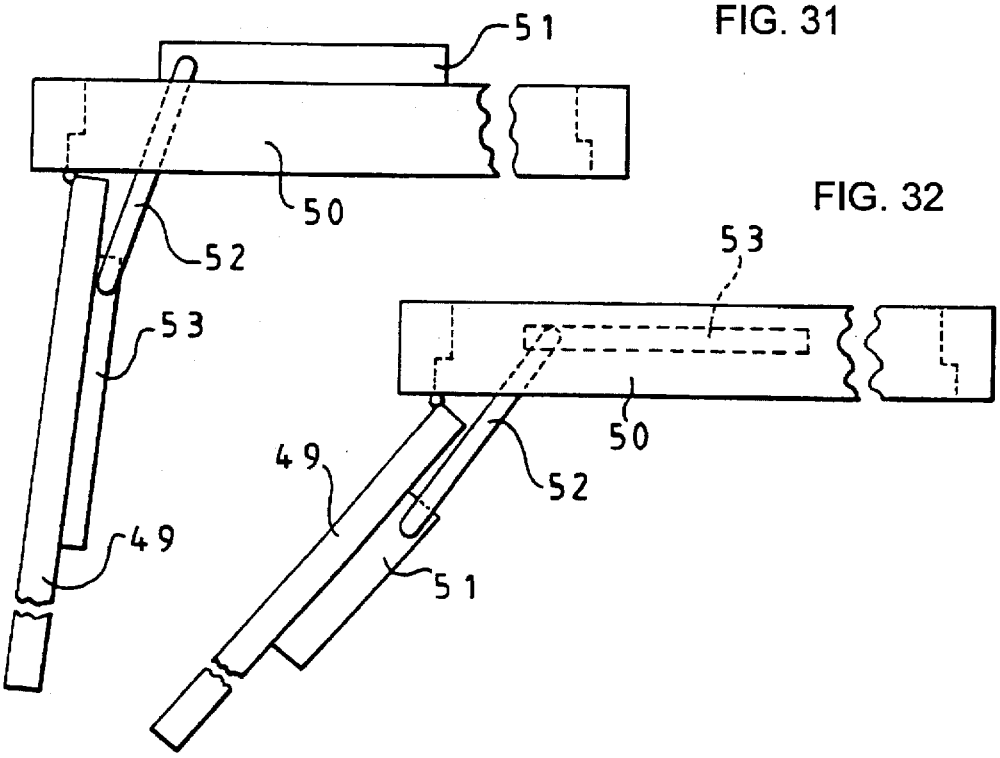
FIG. 32

DEVICE FOR CONTROLLING THE MOVEMENT OF A WING

FIELD OF THE INVENTION

This invention relates to a device for controling the movement of a wing, and is particularly for use where the wing is a door. However the term 'wing' includes in its scope alternatives such as panels and like swingable members,

FIELD OF THE INVENTION

Devices for the automatic closing of a door are well known, and in one form such a device comprises a spindle rotatable in use about an axis parallel to the axis of rotation of the door and means converting rotation of the spindle in one direction into compression of a spring when the door is opened, some form of arm arrangement being provided between the door or frame, i.e. whichever does not have the closer attached thereto, and the closer spindle, in order to rotate the spindle in said one direction upon said opening of the door.

A common form of arm arrangement comprises a main arm extending from the closer spindle, with a link pivotally connected at one of its ends to the free end of the main arm and intended to be fixed at its opposite end to the one of the door and frame which does not carry the closer. Such an arrangement acts in a 'scissors' manner as the door is opened and closed.

Instead of a multi-arm linkage between the door or frame and the closer spindle, a more aesthetically pleasing linkage is now considered desirable, and accordingly the linkage is now often in the form of a single link arm coupled at one of its ends to the closer spindle and engaging into a guide rail by way of suitable means, such as a slider or a roller, at its other end.

With many doors, a closer used therewith must operate so that the torque exerted thereby is sufficient to close the door against a catch when the door is in its fully closed position. Normally the arrangement of the closer spring is such that the force it exerts and thus the torque generated at the spindle is at a minimum at the door closed position and maximum at the door fully open position. This is clearly contrary to the desired characteristic, namely low torque when the door is open and high torque at door opening.

The torque generated at the closer spindle is thus an important consideration, and, for example, with a single link arm closer referred to above, the closing moments are unfavourable. Even by using a relatively long guide rail, the problem may be only marginally mitigated, if at all.

Various arrangements have been used in a door closer to try to achieve the desired torque characteristics, such as a pair of relatively movable pistons, gears in mesh with the closer spindle, a rack with differently radiused sections and/or sections with differently shaped teeth, and a stroke-producing cam disc.

FIGS. 1 and 2 show a prior art arrangement in a door closer where the closer spindle 10 has a crank part 11 forming a first link. Pivotally connected to the part 11 at one of its ends is a short second link 12. The closer spring 13 has its end nearest the spindle held against a stop 14, its other end being engaged by a piston 15 slidable in a cylindrical housing, the piston being centrally grooved for reception of an appropriate seal (not shown). A third, relatively long link 16 is pivotally connected at one end to the piston, extends through the coiled compression spring 13, and has its other end pivotally connected to the other end of the second link 12. Finally a fourth link 17 has one of its ends pivotally secured to the closer body at a position below the position of the spindle axis and between said axis and the stop 14, as viewed in FIGS. 1 and 2. The other end of the fourth link is pivotally connected at the pivotal connection of the second and third links, marked 'A' in the figures. The pivotal connection of the first and second links is marked 'B' and the pivot of the fourth link to the closer body marked 'C'. The fourth link is longer than the second link and angular movement of this link guides the common pivot of the second and third links in an arcuate path when the spindle moves angularly.

FIG. 1 shows the positions of the four links when the door is in its closed position and the spring 13 is in its relaxed state. When the door is opened, the closer spindle is moved angularly by the external door closer linkage and the link 12 is pulled around anti-clockwise with the part 11. This movement of the link 12 effectively pulls the link 16 generally axially of the housing thereby pulling the piston 15 towards the stop 14 and compressing the spring.

As the link 12 moves, its pivotal connection to the link 16 is guided by the link 17 as explained above, so that this connection 'A' moves along an arc of the circle centred at 'C' and having a radius equal to the distance AC. Clearly connection 'B' similarly moves along an arc of the circle centred on the closer spindle, and having a radius equal to the distance from the axis of the spindle to connection 'B'.

FIG. 3 is a graph showing torque plotted against spindle rotation for the arrangement of FIGS. 1 and 2. The torque profile is for the closer itself, the actual torque produced at the door being modified by the external linkage. However for comparison referred to hereinafter, the angles shown can effectively be regarded as degrees of door opening.

It will thus be appreciated that the torque profile of this closer does not satisfy the requirements referred to.

SUMMARY OF THE INVENTION

It is an object of the invention to provide an improved device for controlling the movement of a wing.

According to the present invention there is provided a device for controlling the movement of a wing comprising a housing, resilient means in the housing, a piston reciprocally movable in one direction under the influence of said resilient means and in the opposite direction under the influence of an arm mechanism connected to the housing, in use, the arm mechanism having an arm angularly movable about an axis defined in the housing, and a linkage mechanism between said axis and the piston arranged so that a greater torque is exerted, in use, on said arm when the resilient means is in its least or substantially least compressed state, corresponding to a closed or near closed position of the wing, in use, than when the resilient means is compressed beyond its least or substantially least compressed state, corresponding to an open position of the wing.

Preferably the maximum torque exerted on said arm is in the near closed position of the wing.

Desirably the linkage mechanism comprises a first link angularly movable about said axis, a second link pivotally connected to the piston, and a third link having spaced pivotal connections to said first and second links respectively, the connection of said second and third links being constrained to move along a predetermined path upon angular movement of said first link, in use. Preferably said predetermined path has at least a portion of arcuate form with the centre of curvature thereof lying outside said housing.

Conveniently in one embodiment said connection is constrained to move along a single arc. Advantageously the arc is defined as a cam track in the housing which is engaged by a cam follower at said connection. Alternatively said connection can be constrained to move by means of a fourth link pivotally connected to the housing and also pivotally connected to said second and third links at said connection.

A kit of parts according to the invention comprises a device of the invention as hereinbefore defined together with an arm mechanism in the form of a single link arm, connectible at one end to said housing for angular movement about said axis defined in the housing, and a guide rail with which the other end of the single link arm engages.

BRIEF DESCRIPTION OF THE DRAWINGS

FIGS. 9 and 10 are a part-sectional side view and a part-sectional top view respectively of the device of the invention shown in FIGS. 4 and 5, with the linkage mechanism in its 'door closed' position;

FIG. 11 is a part-sectional exploded side view of various parts of the construction of FIGS. 9 and 10;

FIG. 12 is a plan view of one of the components of FIG. 11;

FIGS. 28, 29, 30, 31, and 32 show diagrammatically various alternative ways of mounting a device of the invention together with its associated single slide arm and guide rail at a door and associated transom.

DETAILED DESCRIPTION OF THE PREFERRED EMBODIMENTS

Figure 1:
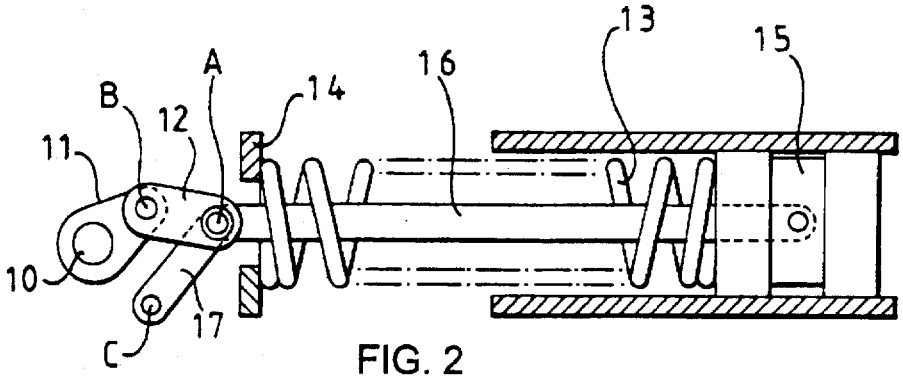
FIG. 1 (PRIOR ART)
FIGS. 1 and 2 are schematic diagrams showing the positions of the links of a four arm linkage mechanism of a prior art door closer at the door closed and door open positions respectively.
Figure 2:
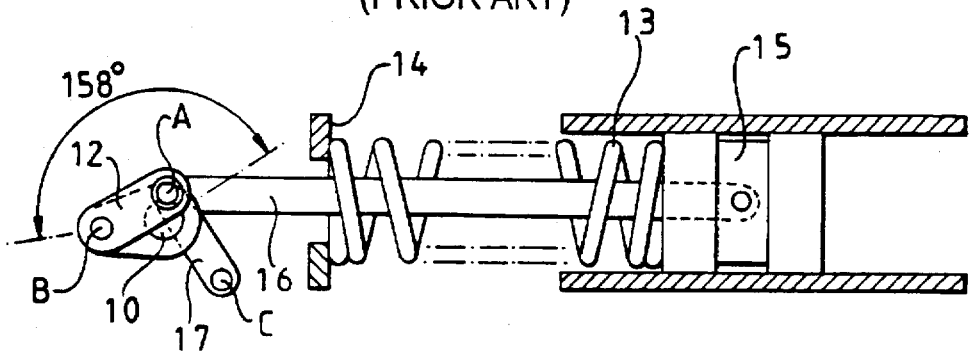
FIG. 2 (PRIOR ART)

As described, the operation of the linkage arrangement shown in the door closer of FIGS. 1 and 2 does not provide maximum torque at the closer output spindle as has been described as being desirable. The present invention provides a device for controlling the movement of a wing, particularly in the form of a door closer, which does provide the torque characteristics desired.

Figure 4:
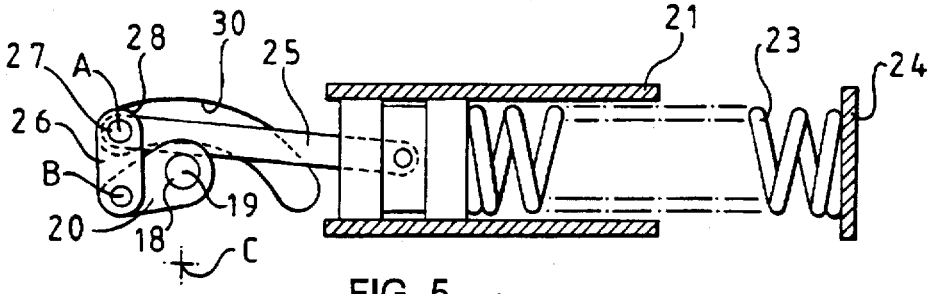
FIGS. 4 and 5 are views as FIGS. 1 and 2, but for a device according to the invention.
Figure 5:
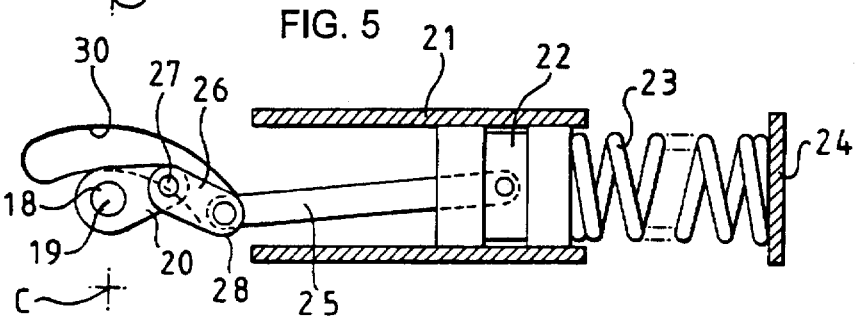

Before describing a first embodiment of such a door closer of the invention in detail, reference is made to FIGS. 4 and 5 which, like FIGS. 1 and 2 show the arrangement of the links of the linkage mechanism within the door closer at the door closed and door opened positions respectively.

As can be seen from FIGS. 4 and 5, there is a operating spindle 18 arranged, as will be described, to be mounted in a housing of the closer for angular movement about an axis 19 defined thereby. The spindle has an integral crank part 20 mid-way between its ends, this part 20 extending generally radially from the axis of the spindle and constituting a first link. Like the prior art arrangement shown in FIGS. 1 and 2, the embodiment of the invention shown in FIGS. 4 and 5 has a cylindrical housing 21 within which is reciprocally movable a piston 22 which is in engagement with resilient means in the form of a coiled compression spring 23. However the arrangement illustrated is in essence the reverse of that shown in the prior art arrangement in that as can be seen from FIGS. 4 and 5, the piston is between the spring and the operating spindle so that the stop 24 against which the end of the spring remote from the piston engages is itself remote from the linkage arrangement. Thus as shown in FIG. 4, the piston is nearest the spindle 18 in the door closed position and furthest therefrom in the door open position, namely the reverse of that shown with the prior art arrangement, so that whereas in FIG. 1 the crank part 11 moves anti-clockwise to cause compression of the spring 13, the crank part 20 of FIG. 4 moves clockwise. However the linkage arrangement of the invention could instead be used with a closer having its spring at the side of the piston nearer the crank part, i.e. as in FIGS. 1 and 2.

Extending into the housing 27 shown in FIGS. 4 and 5, in a direction generally axially, is an elongated second link 25 which at its one end is pivotally connected to the piston. As shown in FIG. 10 the piston is cut-away adjacent this pivot to allow for limited angular movement of the link each side of the central axis of the cylindrical housing.

Pivotally connected to the end of the crank part away from the spindle 18 is a double-armed third link 26, the two arms being aligned one above the other at opposite sides of the crank part with a pivot pin therethrough, this constituting the pivot '13' shown in FIGS. 4 and 5. At their opposite ends respectively the arms engage at respective opposite sides of the end of the link 25 remote from the piston. Passing through this connection of the link 25 to the link 26 is a cylindrical pivot pin 27 on the opposite ends of which are respective circular cam followers 28, 29 with internal bearings. Bearings are also provided for the spindle 18 to move angularly in the housing.

These cam followers are received in respective aligned upper and lower cam tracks 30, 31 respectively, (FIGS. 9–12), provided in respective side cheeks forming part of the housing. As can be seen for cam track 30 from FIGS. 4 and 5, the cam track is arcuate, being part of a circle centred at the point 'C' which, in this embodiment, and as viewed in FIGS. 4 and 5, is below the axis of the spindle 18 on a line therethrough normal to the axis of the housing 21. In this embodiment the radius of the circle of which the cam track is part is of a length such that the majority of the cam track is at the side of the spindle axis away from the centre 'C', and moreover the section of the arc provided for the cam tracks is not symmetrical about the vertical line through the centre 'C' and the axis of the spindle, but extends to a greater extent to the right of this line, namely towards the cylindrical housing 21. However, as will become apparent, the path through which the cam followers are guided need not be a single arc. It can be any continuous curve, the instantaneous centre of curvature of which can be chosen to allow optimisation of the torque profile, and, for example, could have two or more sections of different radii respectively so as to 'fine tune' the torque characteristics. Use can be made of the ability to 'tune' the output torque profile by varying the cam track from a circular arc. The basic mechanism geometry, as described, provides a basis by giving a sharp rise in torque at closing. The cam track can then be 'tuned' to optimise the torque profile. An example of such tuning is described hereinafter with reference to FIGS. 13 to 16 where the position of the centre 'C' and the length of the radius taken from 'C' are varied. As referred to herein, the cam profile is the path which the centre line of a cam follower describes.

FIGS. 9 to 12 show constructional features of the embodiment of FIGS. 4 and 5 in more detail, with the numerals used in those figures also being used in FIGS. 9 to 12. In particular it will be noted that the housing for the piston and compression spring is in this embodiment formed with the stop 24 being removable, and having an integral forward extension 32 to opposite sides of which are secured by means of screw holes 33 upper and lower housing parts 34, 35 respectively in the form of cheeks, in which are defined the upper and lower cam tracks 30, 31 respectively. These housing parts also serve to journal the spindle 18 as shown in FIG. 9. As previously described a portion of approximate sector shape is cut-away from the centre of the piston in a horizontal plane, as viewed in FIG. 9, to allow for movement of this end part of the link 25. FIG. 12 shows a housing part 34, (housing part 35 being a mirror image), in inside plan view.

The relative positions of the links are as shown in FIG. 4 when the door is closed, namely with the cam followers at the extreme left hand ends of their respective cam tracks, and the piston thus at the extreme left hand end of its travel in the housing 21, the compression spring thus being in its least compressed state. Maximum torque on the door closer arm, to be described, is exerted upon initial opening of the door or at a near closed position, i.e. when it is opened at a small angle, such as 2° as per DIN standard. However as used herein, 'near closed' could with certain closer arrangements include an opening angle of up to 10°, although normally the angle would be 5° or less.

Thereafter for at least a substantial portion of the door opening or further opening, the torque falls, with any subsequent rises in torque only reaching levels which are well below the initial opening torque described. Eventually, as can be seen in FIG. 5, the cam followers reach the end of their respective tracks, this occurring simultaneously, so that the maximum opening position of the door has then been reached, the piston having compressed the spring.

Although it is possible to use a 'scissors' form of exterior arm mechanism with a device of the present invention, it is preferable that the spindle 18 is connected to one end of a single link arm, the other end of which has a slide portion, such as a slider or roller, engaged in a guide rail, so that as the door is opened and closed this single arm pivots about the spindle 18 whilst simultaneously sliding along the guide rail. As described previously, this form of linkage from the closer to the door or transom/frame is more aesthetically pleasing than previous multi-arm arrangements, such as those of the 'scissors' type and the like, and the link arrangement of the invention is particularly suitable for use with a single external link arm, in that it does not require the use of a relatively long guide rail as previously proposed with single link arm door closers to try to mitigate the poor torque/rotation profile.

Figure 6:
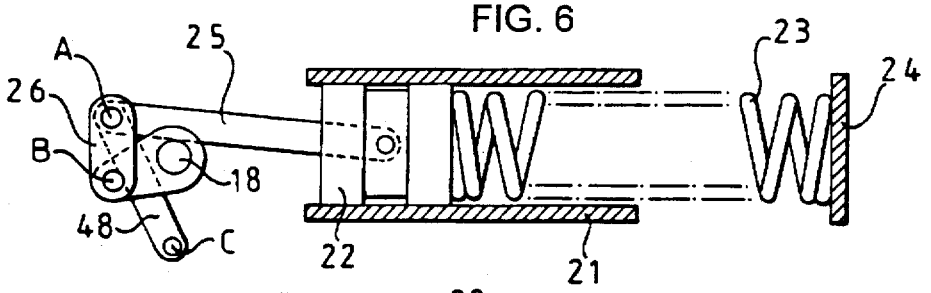
FIGS. 6 and 7 are views as FIGS. 1 and 2, but for a device constructed according to a further embodiment of the invention.
Figure 7:
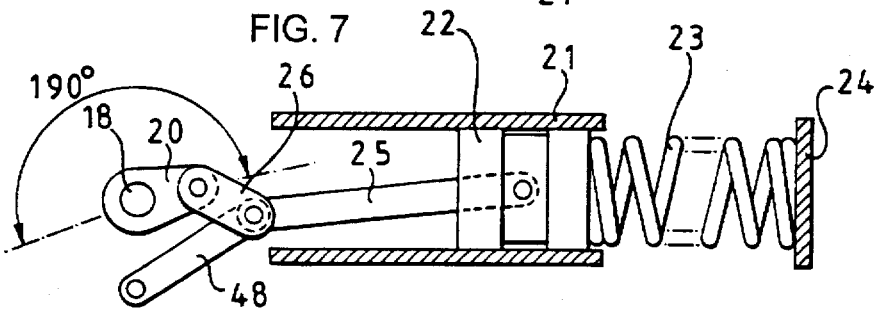

A further embodiment of a device of the present invention shown in FIGS. 6 and 7 is generally similar to that shown in FIGS. 4 and 5 and like numerals have thus been used for equivalent parts. The only difference is the way in which the pivot point 'A' is guided for movement upon movement of the spindle 18. Instead of cam followers and associated cam tracks used in the earlier embodiment described, the guiding here is provided by a fourth link 48. This link, in effect, a physical connection between the point 'C' shown in the embodiment of FIGS. 4 and 5 and the common pivot point 'A' between the links 25 and 26. Thus for example the link 48 can have the same centre as the centre 'C' (but limited to being in the housing) with the distance AC the same as the equivalent distance in the earlier described embodiment. It will thus be appreciated that again the point 'A' will follow an arcuate path of movement upon angular movement of the spindle between the door closed and fully opened positions respectively. This four-arm linkage is a special version of the three-arm linkage of FIGS. 4 and 5. When the cam track is an arc of a circle, it can effectively be replaced by a fourth link.

Figure 3:
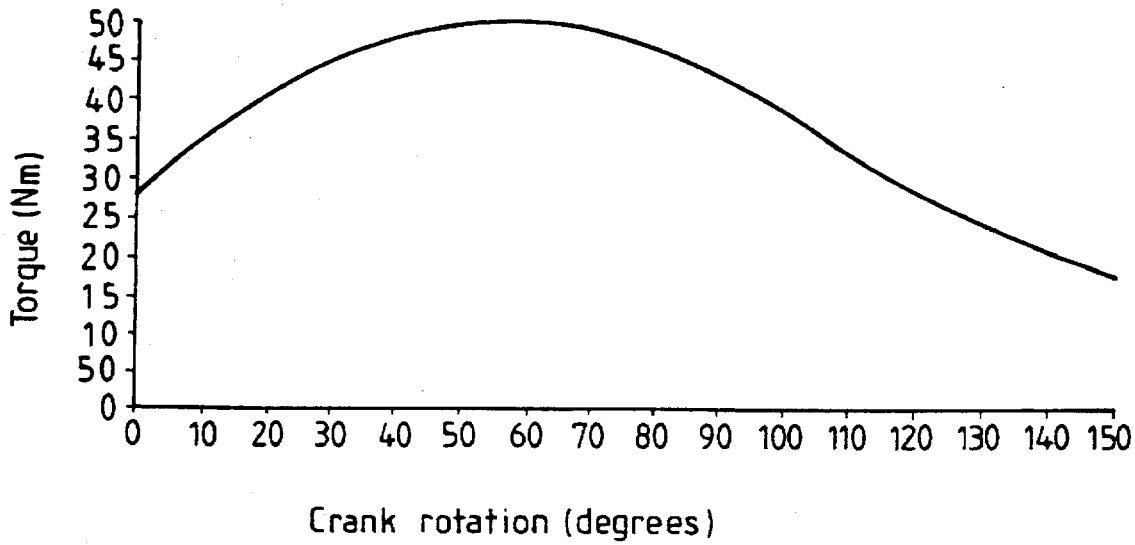
FIG. 3 is a graph showing torque at one of the links connected, in use, to an external arm mechanism, against the angle of angular movement of said link.
Figure 8:
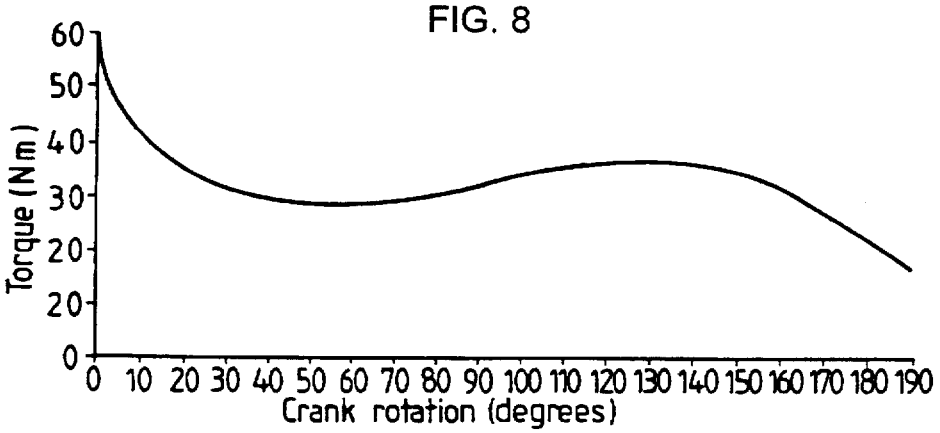
FIG. 8 is a graph as in FIG. 3, but for the further embodiment shown in FIGS. 6 and 7.

FIG. 8 shows, for a device of the invention, a graph which is a plot of torque at the operating spindle against spindle (crank) rotation, and can thus be compared with the graph shown in FIG. 3. Apart from small effects due to different levels of friction loss, this graph will be identical for the mechanisms of FIGS. 4 and 5 and FIGS. 6 and 7 respectively and it can be seen that there is an initial large torque requirement at the crank rest position (door closed), this then falling continually as the door is opened and the crank moves angularly up to approximately 60°. Thereafter there is a slight increase in torque, until there is a further falling off from approximately 140° of crank angular movement onwards, with it being shown from FIG. 7, and also from FIG. 8, that 190° of crank angular movement can be obtained. Again, as described with the first embodiment, it is desirable for the closer to use a single link arm engaging with a guide rail rather than a multi-link arm arrangement. As described, the torque profile of FIG. 8 is for the closer itself, the actual torque produced at a door, and the door opening angle, being further modified by the external linkage. As stated, the profile is best reproduced by the use of a single link arm.

Although the embodiment of FIGS. 6 and 7 produces the desired torque effect, the embodiment of FIGS. 4 and 5 is advantageous in allowing for the provision of 'fine tuning' and in providing a more efficient, stronger and more compact mechanism.

FIGS. 13 to 16 relate to a still further embodiment of the invention in which the cam track of the first embodiment of FIGS. 4 and 5 is fine tuned as earlier mentioned. However equivalent parts are similarly numbered, with the addition of the suffix 'a'.

Figure 13:
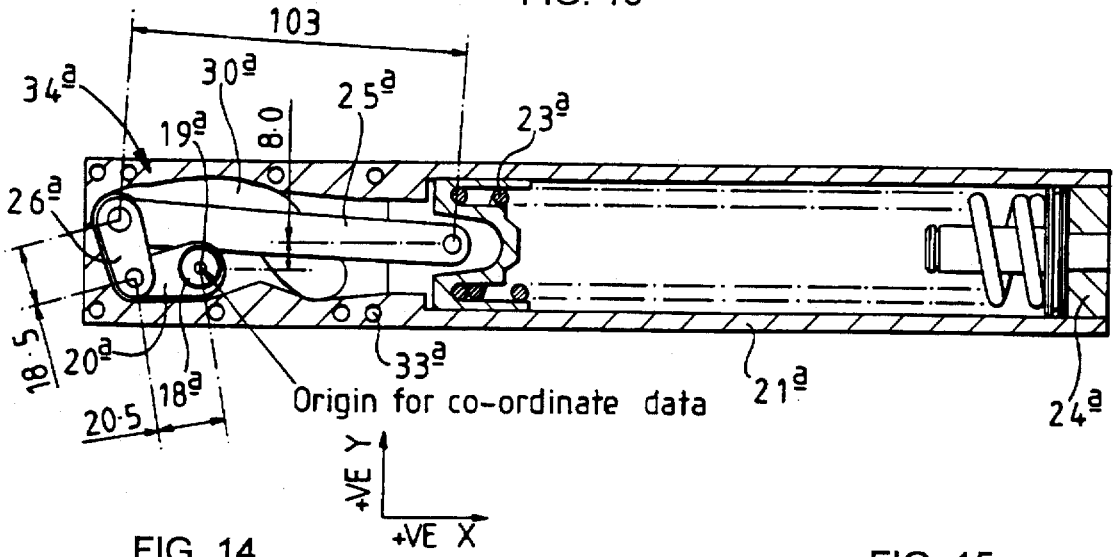
FIG. 13 is a view like FIG. 10 of a device of the invention according to a still further embodiment.

FIG. 13 is a view of the door closer of this still further embodiment in a similar form to that shown in FIG. 10. However here the linkages are relatively positioned slightly differently in this 'door closed' position and, more importantly, it can be seen that the cam track in each cheek forming part of opposite sides of the body is no longer a simple circular arc. Instead the cam track 30*a* is made up of a series of points using differing radii of curvature and differently positioned centres, with a curve being constructed between the points. An alternative way of. regarding the profile is that it made up of a series of arcs of different curvature and centres.

Figure 14:
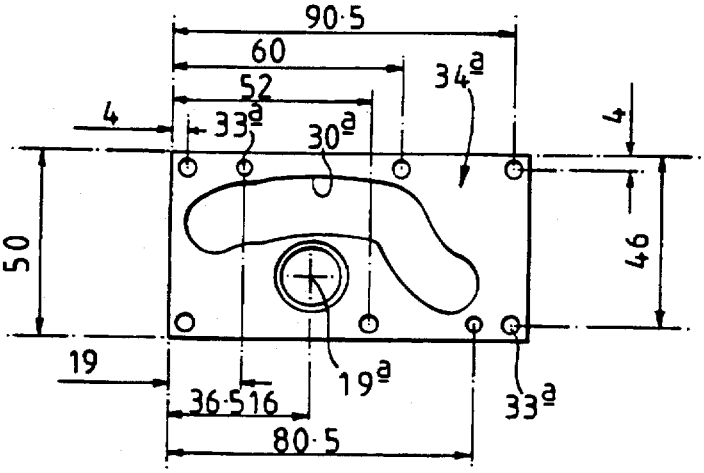
FIGS. 14 and 15 are a side view and a perspective view respectively of part of a housing of the device of FIG. 13.

FIGS. 13 and 14 include dimensions in mm for the links and the cheek (and thus for this end part of the housing), whilst Table 1 gives values for the X and Y co-ordinates of the centre line of the cam track, the origin for the co-ordinate data being at the axis 19*a* of spindle 18*a*. Table 2 gives values of the co-ordinates for the instantaneous centres of curvature and radii of curvature for the centre line of the cam track of Table 1, i.e. for each of the series of points (arcs) making up the track.

Figure 16:
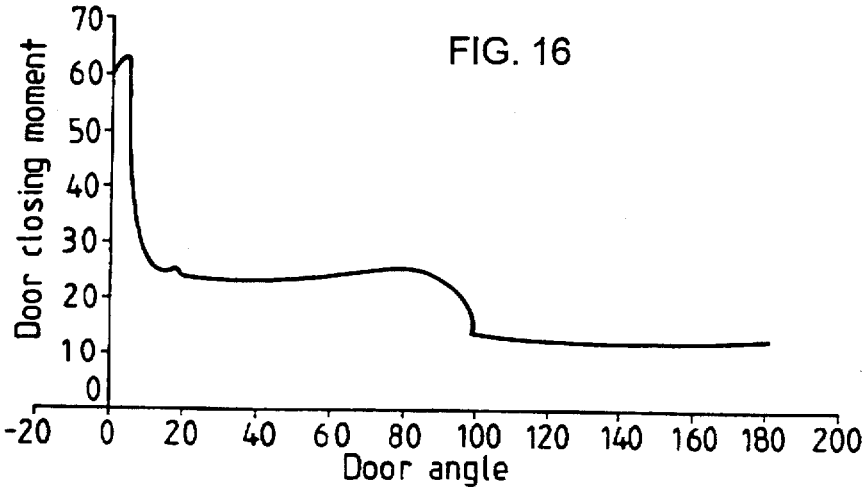
FIG. 16 is a graph showing door closing moment against door angular movement for the device of FIG. 13 when fitted to a door.

FIG. 16, is a graph of door closing moment against door opening angle for this still further embodiment, and it can be seen that when the cam tracks are 'tuned' the closing moment or torque more closely approaches the ideal requirement for the whole of the door opening movement, up to, in this example, over 180°. Compared to the graph of FIG. 8, it can be seen that with this 'tuned' cam track arrangement, the fall after initial opening of 2° is much steeper and that from about 10° to 90° of door opening the moment is almost constant, before thereafter reducing at 100° of opening and then remaining substantially constant to maximum door opening. However the two curves are different in principle because the FIG. 16 curve depends upon the geometry of the external links and the mounting on the door, whereas the FIG. 8 curve is a property of the closer alone. The external links alter not just the torque but also the opening angle. Thus at 190° crank rotation the door may have opened through less than 180°.

The co-ordinate values given in Table 2 indicate that some of the centres lie outside of the closer housing, these being those where Y>25 mm or Y<−25 mm.

Figure 17:
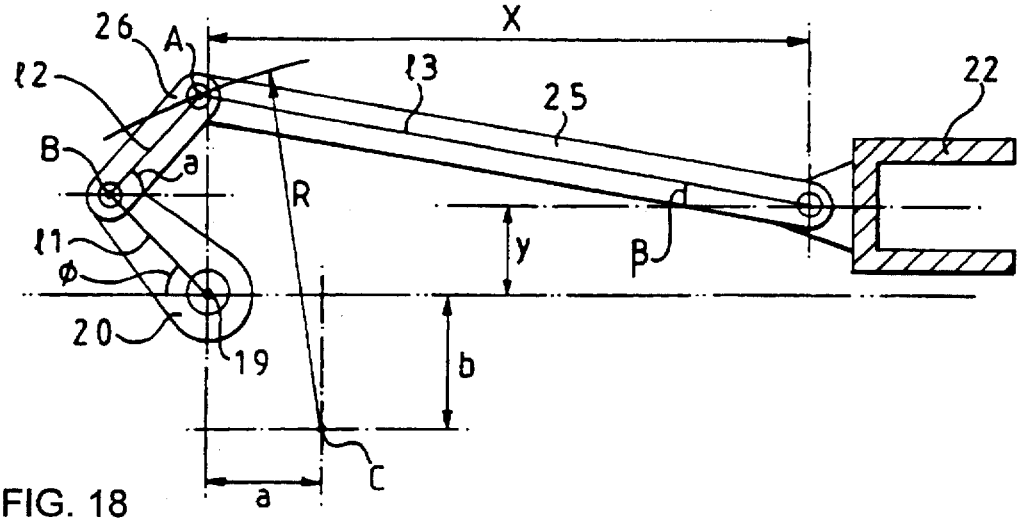
FIG. 17 is a diagram showing the geometry of the linkage arrangement of a device of the invention.
Figure 18:
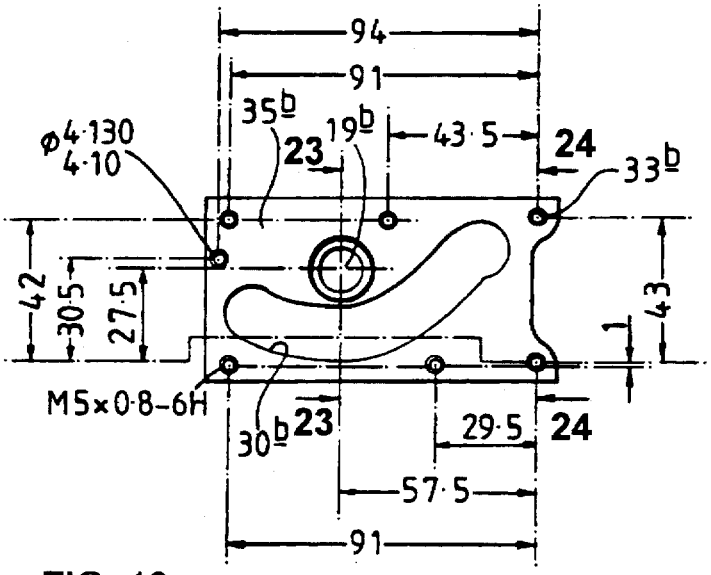
FIGS. 18, 19 and 20 respectively show an inner face, an outer face and a side view of an alternative form of the component of FIGS. 14 and 15.
Figure 19:
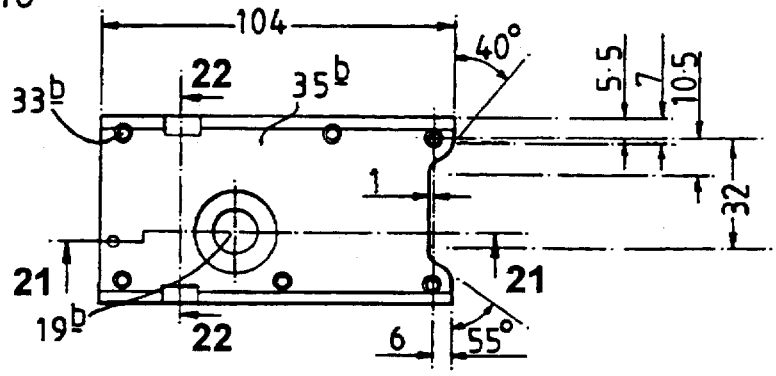
Figure 20:
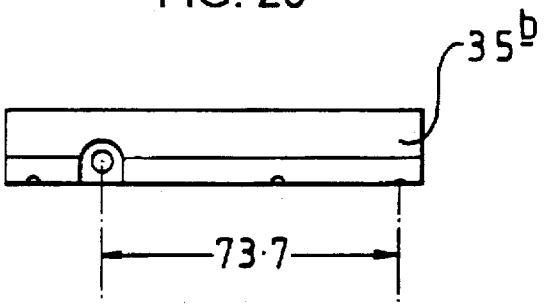
Figure 21:
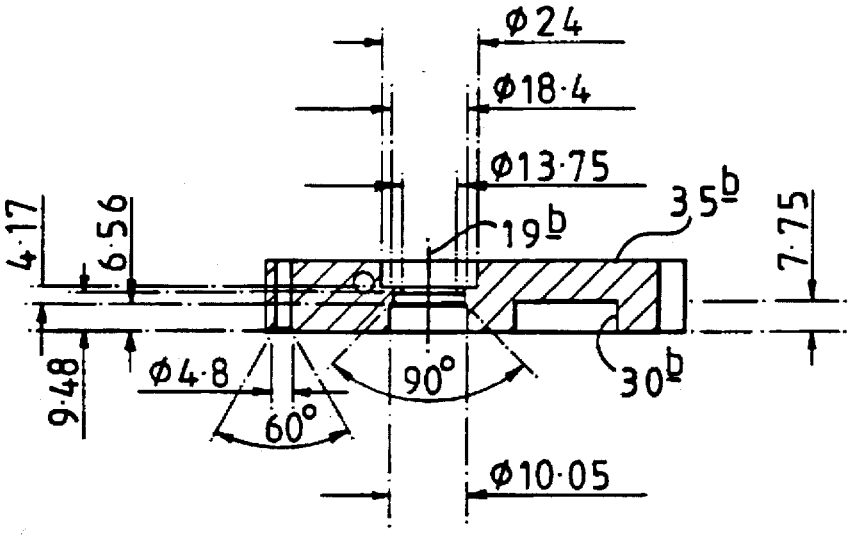
FIGS. 21, 22, 23, and 24 respectively are cross-sections on the lines 21—21 and 22—22 on FIG. 19, and on the lines 23—23 and 24—24 on FIG. 18.
Figure 22:
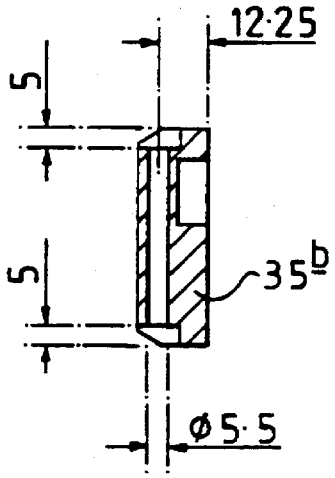
Figure 23:
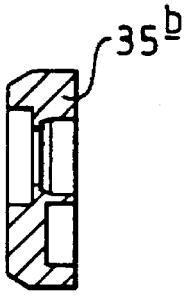
Figure 24:
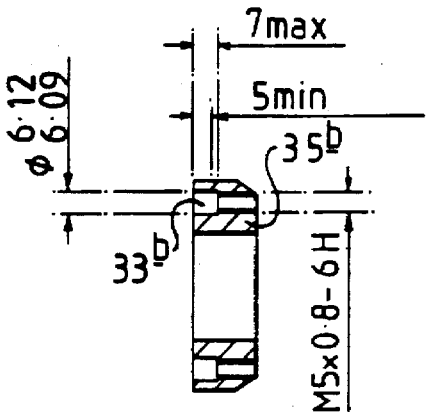

FIG. 17 is a diagram showing the link geometry for a crank slider mechanism moving along a portion of a cam track defined by an arc of circle radius R. In other words it represents the geometry of the arrangement of FIGS. 4 and 5.

The crank part 20 has a length $l_1$, with the link 25 having a length $l_3$ and the link 26 having a length $l_2$. The angle which the link 25 makes with the line along which the crank slider moves is denoted by β, whilst the distance in a line parallel to said line between axis 19 and the pivot of link 25 to the piston slider 22 is x. A line is shown through axis 19 parallel to the line along which the crank slider moves, and the angle of crank part 20 to that line is denoted by ϕ. Similarly the angle of link 26 to a line through point B parallel to the crank slider line of movement is denoted by δ. Finally the radius R is shown struck from a centre C which is defined by co-ordinates a and b with an origin at axis 19, and the parallel lines through the axis 19 and along which the crank slider moves respectively, are spaced apart by a distance y. From this geometry three equations can be written:

$$y=l_1\sin\phi+l_2\sin\delta-l_3\sin\beta \quad (1)$$

$$(a+l_1\cos\phi-l_2\cos\delta)^2+(b+l_1\sin\phi+l_2\sin\delta)^2=R^2 \quad (2)$$

$$x=l_2\cos\delta-l_1\cos\phi+l_3\cos\beta \quad (3)$$

From equations (1) and (2) it is possible to derive expressions for β and δ in terms of ϕ, $l_1$, $l_2$, $l_3$, a, b, y and R. By substituting for β and δ in equation (3) it is possible to derive an expression for x which is a function of ϕ, $l_1$, $l_2$, $l_3$, a, b, y and R, i.e.

$$x=x(\phi, l_1, l_2, l_3, a, b, y, R)$$

This relates the position of the piston pivot to the geometry and crank angle only, since for a particular linkage $l_1$, $l_2$, $l_3$ and y are fixed and a, b and R are either fixed, where the path of movement of A is a circular arc, or are variable, but known, for the points making up the cam track, as described previously in relation to Tables 1 and 2. Accordingly by selecting values satisfying this expression, the linkage will provide the torque curve required, as a result of there being a high mechanical advantage around initial door opening. Thereafter a reduction takes place which is proportional to the torque curve given. The mechanical advantage is present in the linkage in the closer itself, and also in the

TABLE 1

Co-ordinates for the centre line of the cam track

| X (mm) | Y (mm) |
|---|---|
| −25.2875000 | 14.2236500 |
| −24.5718000 | 14.5971300 |
| −23.8654000 | 14.9359100 |
| −23.1685000 | 15.2422000 |
| −22.4813000 | 15.5179700 |
| −21.8038000 | 15.7649900 |
| −21.1360000 | 15.9848500 |
| −20.4782000 | 16.1790100 |
| −19.8302000 | 16.3487700 |
| −19.1922000 | 16.4953200 |
| −18.5640000 | 16.6197700 |
| −17.9458000 | 16.7231100 |
| −17.3374000 | 16.8062600 |
| −16.7390000 | 16.8700600 |
| −16.1504000 | 16.9152800 |
| −15.5716000 | 16.9426300 |
| −15.2871000 | 16.9476950 |
| −15.0026000 | 16.9527600 |
| −10.9230700 | 17.7312000 |
| −6.84354000 | 18.5096400 |
| −4.95926000 | 18.7431200 |
| −3.16631000 | 18.8954500 |
| −1.44199000 | 18.9783400 |
| 0.23136900 | 18.9994400 |
| 1.86784000 | 18.9636400 |
| 3.47880400 | 18.8737700 |
| 11.9955979 | 18.0961145 |
| 16.6279066 | 17.6711462 |
| 19.2253797 | 17.0708640 |
| 21.5719458 | 15.8056237 |
| 23.5008295 | 13.9653484 |
| 24.8749412 | 11.6808303 |
| 25.3656800 | 10.6236300 |
| 26.1907600 | 9.09131500 |
| 27.0445700 | 7.70104700 |
| 27.9228000 | 6.40511500 |
| 28.8229200 | 5.18080400 |
| 29.7430600 | 4.01867200 |
| 30.6814600 | 2.91788900 |
| 31.6361300 | 1.88457100 |
| 32.6045600 | 0.93152900 |
| 33.5835000 | 0.07915300 |
| 34.5685800 | −0.64188000 |
| 35.5538200 | −1.18481000 |
| 36.5306700 | −1.47272000 |
| 38.0392193 | −1.38556281 |

TABLE 2

| Co-ordinates for the instantaneous centres of curvature and radius of curvature fo the centre line of the cam track | | |
|---|---|---|
| X (mm) | Y (mm) | Radius (mm) |
| −14.038411 | −6.4604996 | 23.545192 |
| −14.038401 | −6.460508 | 23.545204 |
| −14.169443 | −6.1792787 | 23.234948 |
| −14.252972 | −5.9805746 | 23.019401 |
| −14.387021 | −5.629553 | 22.643654 |
| −14.445398 | −5.4612139 | 22.46548 |
| −14.515548 | −5.2333931 | 22.227106 |
| −14.608426 | −4.9051815 | 21.886009 |
| −14.67401 | −4.6364808 | 21.60942 |
| −14.739957 | −4.3310159 | 21.296918 |
| −14.793033 | −4.0381195 | 20.999252 |
| −14.84237 | −3.7169913 | 20.674357 |
| −14.878351 | −3.4197375 | 20.374933 |
| −14.91151 | −3.0638923 | 20.017547 |
| −15.053439 | −0.161228 | 17.111705 |
| >100 | <−100 | >100 |
| >100 | <−100 | >100 |
| −18.516075 | 46.444555 | 29.700344 |
| −0.200187 | −27.384745 | 46.37271 |
| −0.1005176 | −28.189136 | 47.183091 |
| 0.0005644 | −29.007028 | 48.007046 |
| 0.0001059 | −28.997411 | 47.99742 |
| −0.0002557 | −28.995658 | 47.995656 |
| −0.0001661 | −29.00503 | 48.005028 |
| −0.0000256 | −29.002366 | 48.002361 |
| <−100 | <−100 | >100 |
| <−100 | <−100 | >100 |
| 15.69506 | 7.7147507 | 10.00000 |
| 15.695059 | 7.7147497 | 10.00000 |
| 15.695061 | 7.714753 | 9.99999 |
| 15.695055 | 7.7147483 | 10.00000 |
| 45.63772 | 20.676148 | 22.627609 |
| 49.37345 | 22.562401 | 26.81244 |
| 54.738933 | 25.666391 | 33.011079 |
| 59.297154 | 28.612502 | 38.438498 |
| 61.968902 | 30.492949 | 41.705644 |
| 62.116935 | 30.596635 | 41.886226 |
| 59.619785 | 28.537728 | 38.649745 |
| 55.230381 | 24.640677 | 32.7800 |
| 50.122775 | 19.701151 | 25.674629 |
| 45.195122 | 14.403249 | 18.439347 |
| 41.178815 | 9.4224938 | 12.041047 |
| 38.425733 | 5.1921801 | 6.9938465 |
| 37.03898 | 2.0530576 | 3.5622306 |
| 36.839788 | 3.0673249 | 4.5505562 |

TABLE 3

| Co-ordinates for the centre line of the cam track | |
|---|---|
| X (mm) | Y (mm) |
| −26.4456100 | −12.9493200 |
| −25.3109800 | −13.6996000 |
| −24.2001600 | −14.3639500 |
| −23.1139500 | −14.9509700 |
| −22.0529000 | −15.4680500 |
| −21.0173900 | −15.9216300 |
| −20.0076400 | −16.3173700 |
| −19.0238000 | −16.6602900 |
| −18.0659200 | −16.9548800 |
| −17.1339500 | −17.2051800 |
| −16.2278500 | −17.4148900 |
| −14.1265742 | −17.8241944 |
| −12.0089078 | −18.1384341 |
| −10.3456193 | −18.3363006 |
| −9.05655545 | −18.4870864 |
| −7.62389558 | −18.6546690 |
| −5.78420007 | −18.8670509 |
| −4.17214971 | −19.0584303 |
| −3.51039247 | −19.1358381 |
| −2.59498593 | −19.2294837 |
| −0.70792060 | −19.3335732 |
| 0.81268573 | −19.3309173 |
| 3.11883242 | −19.1793679 |
| 5.10646466 | −18.9041328 |
| 6.14432895 | −18.7059733 |
| 7.50415763 | −18.3882282 |
| 8.51216390 | −18.089752 |
| 10.5619785 | −17.4211828 |
| 12.8940495 | −16.4296269 |
| 15.4724350 | −15.044140 |
| 18.1569158 | −13.2234346 |
| 21.5339298 | −10.4234073 |
| 24.6094131 | −7.84277036 |
| 27.3289566 | −5.56080245 |
| 29.5765136 | −3.55453564 |
| 30.8654138 | −2.28725028 |
| 31.6919344 | −1.42428094 |
| 33.1249000 | 0.16915000 |
| 34.0890000 | 1.21649000 |
| 35.0679000 | 2.20638000 |
| 35.9992252 | 3.10617680 |
| 36.9553252 | 3.95751680 |
| 37.9199939 | 4.69741631 |
| 38.8091477 | 5.24985140 |
| 39.7885366 | 5.76303077 |
| 40.8126684 | 6.18007045 |

geometry from the closer to the door. The spring rate of the closer remains constant.

Typical values for the fixed lengths in the expression for x, are:

$l_1$=20.5 mm $l_2$=23.00 mm $l_3$=97.00 mm y=8.00 mm a, b, R and x are inter-related to optimise the torque profile.

Figure 15:
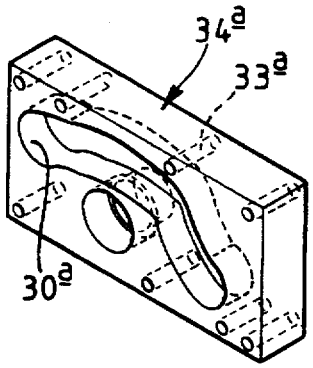

FIGS. 18 to 24 show an alternative form of the fine-tuned cam track of FIGS. 13 to 15. Like FIGS. 14 and 15, dimensions in mm. are included for the lower cheek **35*b*, with the corresponding upper cheek being a mirror image. As compared to upper cheek 34*a* of FIGS. 13 to 15, lower cheek 35*b*** has equivalent parts similarly numbered, but with suffix 'b'.

Figure 25:
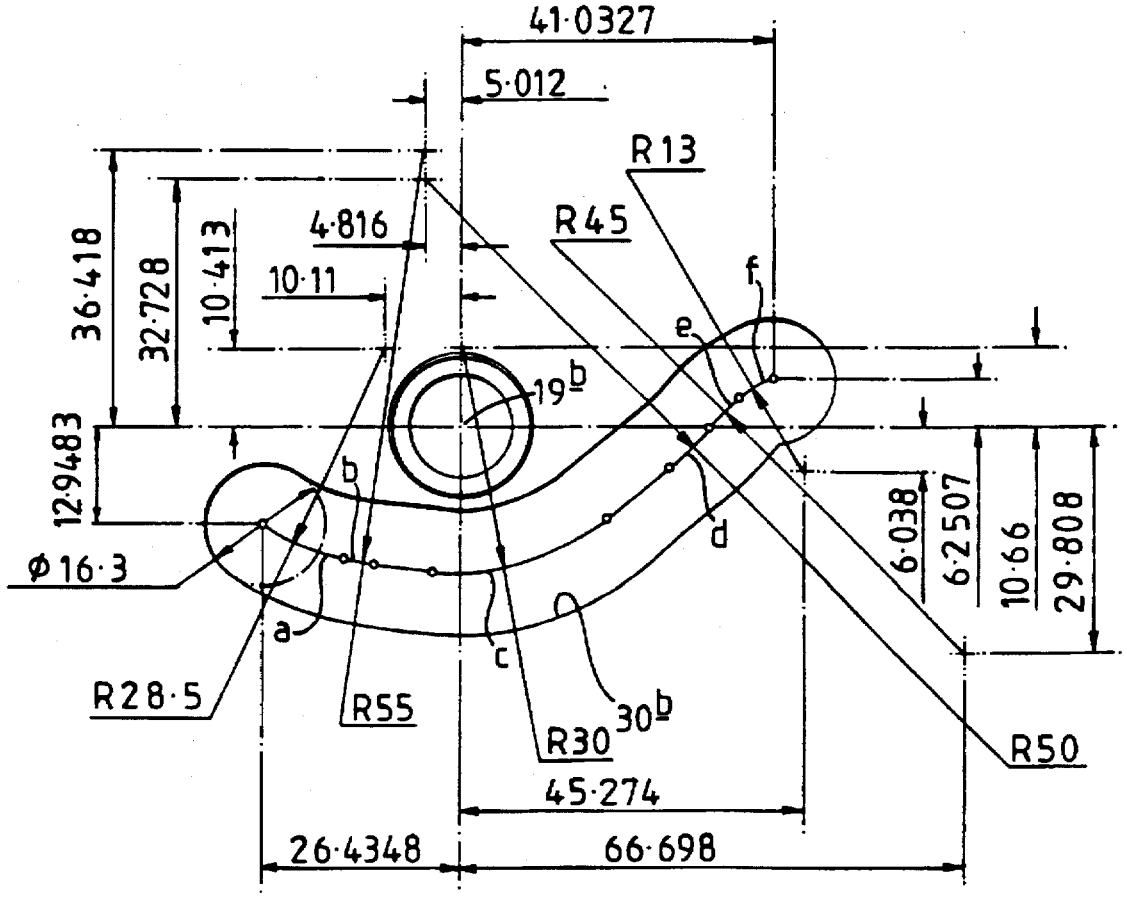
FIG. 25 is a diagram to an enlarged scale showing a cam track in the component of FIGS. 18, 19, 20, 21, 22, 23, and 24.

FIG. 25 is an enlarged view of the fine-tuned cam track **30*b*. This can be regarded as made up of a series of values defining the centre line of the cam track, with the origin for the co-ordinate data being at the axis 19*b* of spindle 18*b***. Selected values are set out in Table *3*, in the same way as for Table 1.

The cam track **30*b* can also, however, in a simplified form, be regarded as being reduced to a series of radii, as shown in FIG. 25**, which includes typical values of radii, as well as other dimensions for this particular example. The centres about which the respective arcs are struck are also shown.

As can be seen from FIG. 25, a part-circular left hand end of the track merges to a first part defined by an arc 'a'. Them then follows a second part defined by an arc 'b' which is joined to a third arc 'c' by a straight line, which is in fact tangential. Them is then a fourth arc 'd' joined by a further tangential straight line to the third arc 'c', and the centre line of the cam track is completed by fifth and sixth arcs 'e' and 'f' respectively. The right hand end of the track is part-circular, but has a local relief to assist assembly, in use, of the follower.

Figure 26:
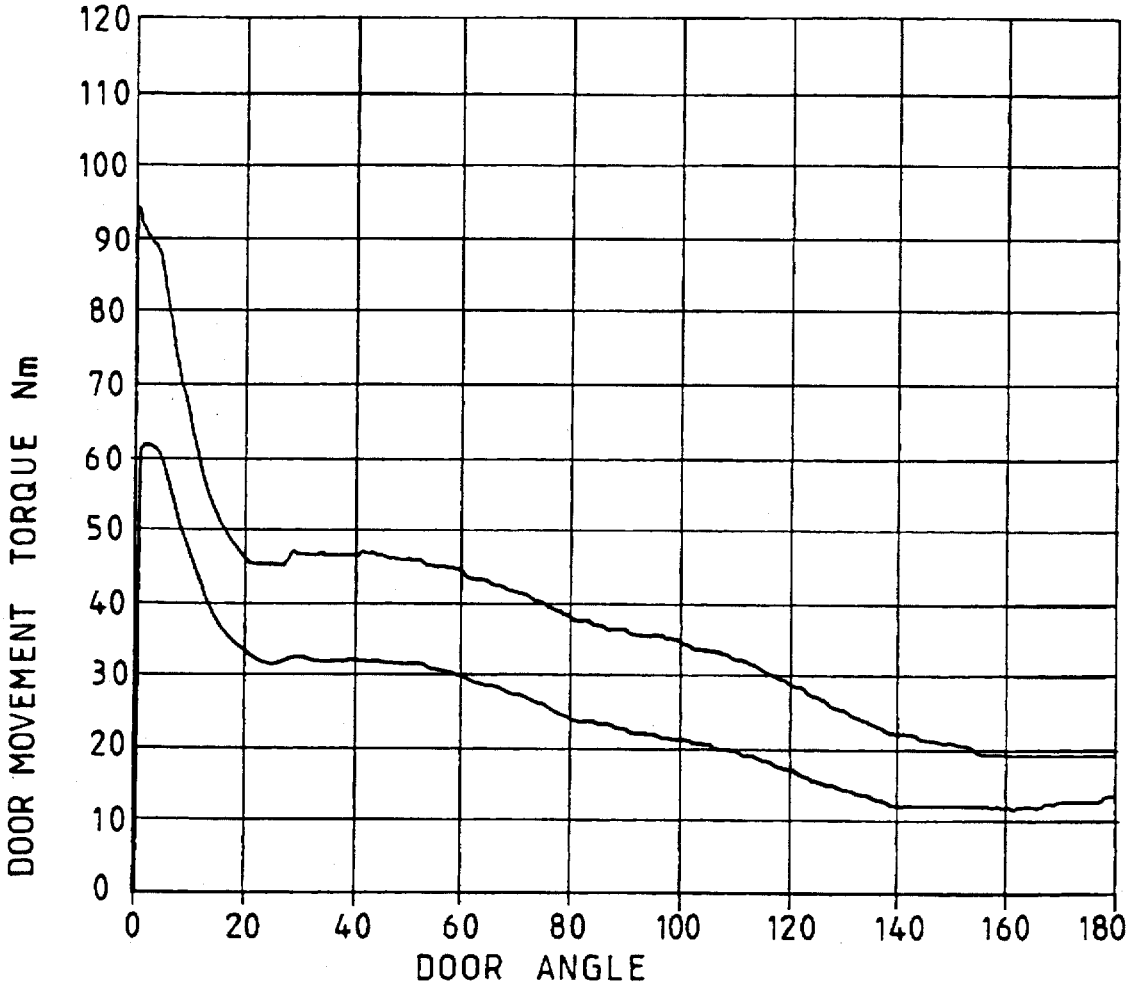
FIG. 26 shows plots of door movement torque against door movement angle for door opening and closing respectively.

FIG. 26 shows two plots of door movement torque against door movement angle for a door closer of the invention incorporating a pair of cheeks each having the cam track of FIGS. 18 to 25. The upper graph corresponds to door opening and the lower graph corresponds to door closing, the difference being attributable to hysteresis loss.

Figure 27:
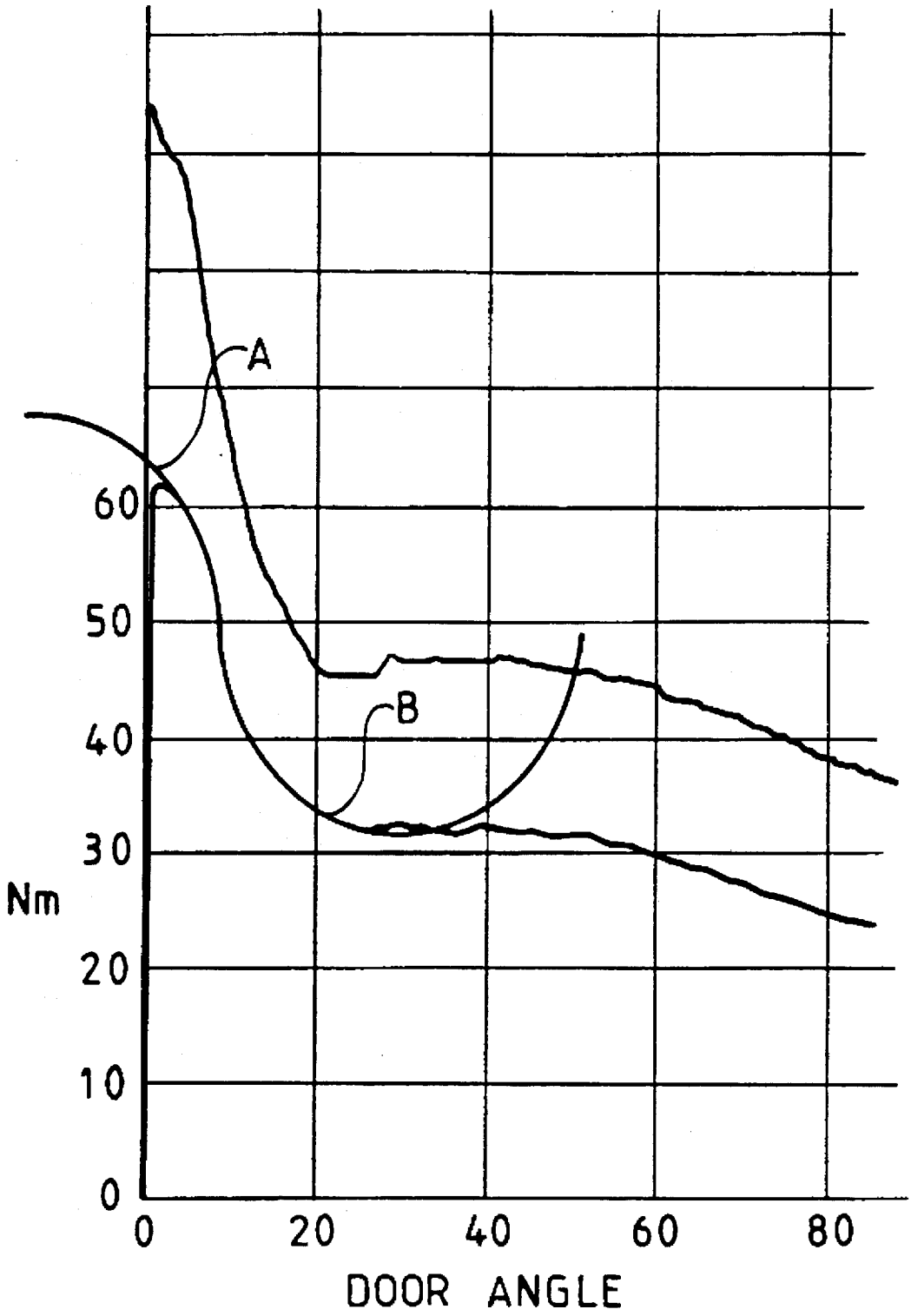
FIG. 27 schematically shows part of one of the plots of FIG. 26 as part of at least two parabolas.

FIG. 27 shows how, at least as an approximation, two interlinked parabolic curves can be fitted to the closing graph of FIG. 26 from the maximum torque position at 2° to approximately 30° of door movement, the first curve 'A' opening downwardly and the second curve 'B' opening upwardly. The torque profiles shown in FIG. 26 are believed to be almost the optimum and to represent an improvement over those of known door closer devices in two aspects, namely:

i) efficiency—less force being required to open the door whilst maintaining the minimum 60 Nm specification (DIN) for closing, ii) torque drop-off and 'flat' portion (meeting a minimum torque figure)

It will be appreciated that a maximum torque position is reached when the rate of change of the torque with door opening or closing is zero.

FIGS. 28 to 32 show various possible arrangements for mounting a device of the present invention at a door and associated transom (frame).

In FIG. 28 there is shown a door 49 with associated transom 50, a device of the invention being shown at 51 having a single slide arm 52 which engages in a guide rail 53. In this embodiment the device 51 is mounted on the pull side of the door with the door being hinged to the transom in a standard manor. With this arrangement it has been found that at 2° of opening the moment (torque) is 58 Nm whilst at 90° of opening the moment is 29 Nm. The embodiment shown in FIG. 29 is similar to that shown in FIG. 28 but uses an offset hinge arrangement. Here the equivalent moments are 54 Nm and 36 Nm respectively. With the third construction, shown in FIG. 30, the device 51 is mounted on the transom at the pull side of the door and standard hinges are used as with the arrangement shown in FIG. 28. Here the moment at 2° of opening is 69 Nm and at 90° of opening is 36 Nm.

FIG. 31 shows an arrangement where the device 51 is transom mounted at the push side of the door, with a maximum opening of 100°. The moment at 2° of opening is 34 Nm with a value of 13 Nm at 90° of opening. Finally with the arrangement shown in FIG. 32, the device 51 is door mounted at the push side thereof, with a maximum opening of 130°. The moment 2° of opening is 60 Nm and 45 Nm at 90° of opening. All these quoted moment values are approximate and may vary within the range of experimental error. The transom mounted arrangement can give the same initial torque as the FIG. 28 application, but thereafter the geometry will change the torque profile. They do however illustrate the desired fall-off in force needed to move the door through ninety degrees.

As well as relating to a device for controlling the movement of a wing, the present invention also relates to such a device together with an arm mechanism in the form of a single slide arm, connectable at one end to the housing for angular movement about the axis defined in the housing and having a slide portion (slide, roller or the like) at its other end, and a guide rail with which the slide portion of the single slide arm engages. A kit of parts would thus be sold comprising the device, the slide arm and the guide rail together with appropriate ancillary fixing means.

Further, although the invention has been described specifically in relation to an overhead door closer, the device of the invention is also applicable for use with a floor spring for controlling the movement of a wing, for example a door. Suitable equivalent resilient means can be used in any versions of devices of the invention instead of a compression spring, for example a bag containing compressible gas. Instead of a pair of spaced cheeks each having the cam track therein, there could be a single cam follower in a single cam track in a single central housing part, the cam follower projecting to opposite sides of the single part where it is connected by respective link arms to the door closer spindle and also to the piston.

I claim:

1. A device for controlling the movement of a wing, comprising a housing, resilient means in the housing, an operating spindle at least partly in the housing and having an axis of rotation, a piston reciprocally movable in one direction under the influence of said resilient means and in the opposite direction upon rotation of said spindle about its axis of rotation upon opening movement of the wing, in use, and a linkage mechanism connected between said axis and the piston, the linkage mechanism comprising a plurality of links, including a first link connected to said spindle and a second link connected to said piston, part of the linkage mechanism being constrained to move in use, along a predetermined path upon rotation of said spindle, so that a greater torque is exerted, in use, at said operating spindle when the resilient means is in its least or substantially least energy storing state, corresponding to a closed or near closed position of the wing, in use, than when the resilient means is in a state in which it stores energy, corresponding to an open position of the wing, said path of the linkage mechanism being constrained to move along said predetermined path by the movement along a cam track of a cam follower carried by the linkage mechanism.

2. A device as claimed in claim 1, wherein the linkage mechanism comprises a first link angularly movable about said axis, a second link pivotally connected to the piston, and a third link having spaced pivotal connections to said first and second links respectively, the connection of said second and third links being constrained to move along said predetermined path upon angular movement of said first link, in use.

3. A device as claimed in claim 2, wherein said third link is connected at its respective opposite ends to said first and second links.

4. A device as claimed in claim 3, wherein said predetermined path is in the form Of a continuous curve.

5. A device as claimed in claim 4, wherein the centre of curvature of at least a portion of said curve lies outside of said housing.

6. A device as claimed in claim 4, wherein said curve is a single arc.

7. A device as claimed in claim 6, wherein the centre of curvature of said single arc lies outside of the housing.

8. A device as claimed in claim 2, wherein respective opposite ends of said operating spindle are journalled in a pair of spaced housing parts which have identically shaped and positioned cam tracks in respective facing internal surfaces thereof.

9. A device as claimed in claim 8, wherein said first link is defined by a crank part of said operating spindle, a pair of arms forming said third link is arranged at respective opposite sides of said crank part and pivotally connected together at said crank part, a pivot pin extends through said arms and part of said second link disposed therebetween, and cam followers carried on respective opposite ends of the pivot pin are respectively received in said cam tracks in said internal surfaces of the housing parts.

10. A device as claimed in claim 2, wherein the second link is pivotally connected at one of its ends to the piston.

11. A device as claimed in claim 10, wherein the piston has a recess at the position of its pivotal connection to the second link, said recess is shaped to allow for angular movement of said second link.

12. A device as claimed in claim 2, wherein the resilient means is arranged to act on an end of the piston opposite to that from which said second link extends.

13. A device as claimed in claim 12, wherein the resilient means acts between said movable piston and an end stop of the housing.

14. A device as claimed in claim 1, in which said resilient means is a compression spring.

15. A device as claimed in claim 1, wherein the maximum torque exerted at said spindle is in the near closed position of the wing, in use.

16. A kit of parts comprising a device as claimed claim 1, an arm mechanism connectible, in use, at one of its ends to said operating spindle for angular movement about said axis, and a guide rail with which the other end of the arm mechanism engages.

17. A kit of parts as claimed in claim 16, wherein the arm mechanism is in the form of a single link arm.

* * * * *